United States Patent [19]

Olowinski

[11] 3,942,314

[45] Mar. 9, 1976

[54] TEXTILE SPINDLE MOUNTING

[75] Inventor: Edward J. Olowinski, Erie, Pa.

[73] Assignee: Lord Corporation, Erie, Pa.

[22] Filed: Nov. 27, 1974

[21] Appl. No.: 527,730

[52] U.S. Cl. ..... 57/135; 308/26; 308/152

[51] Int. Cl.[2] ..... D01H 7/12

[58] Field of Search ..... 57/130, 134, 135; 308/26, 308/149, 152, 155

[56] References Cited

UNITED STATES PATENTS

| | | | |
|---|---|---|---|
| 542,857 | 7/1895 | Klots | 308/152 |
| 545,590 | 9/1895 | Klots | 308/152 |
| 689,362 | 12/1901 | Morrison | 308/152 |
| 1,851,561 | 3/1932 | Baninger | 308/26 X |
| 2,304,370 | 12/1942 | Neal | 57/130 |
| 2,494,023 | 1/1950 | Williams | 308/26 X |
| 3,508,800 | 4/1970 | Beerli | 308/152 |

*Primary Examiner*—Richard C. Queisser
*Assistant Examiner*—Charles Gorenstein
*Attorney, Agent, or Firm*—James W. Wright

[57] ABSTRACT

A noise and vibration attenuating mounting for a textile spindle assembly includes a rigid inner member having an elongate sleeve adapted for attachment to the spindle assembly and a support ring carried by and extending radially from the sleeve. An elastomeric annulus includes portions secured to opposite radial faces of the support ring, preferably in radially spaced relation to the sleeve. A rigid washer is secured along a first free radial face of the annulus in radially spaced relation to the sleeve. A cylindrical casing portion of a holder concentrically surrounds the annulus and support ring in radially spaced relation to the support ring. The holder includes a radially inwardly extending clamping flange secured to the other free radial face of the annulus in radially spaced relation to the sleeve. At least a portion of the washer extends axially beyond the holder. Mounting flanges are provided for attachment of the casing portion of the holder to the spindle rail of a textile machine and allow for precompression of the elastomeric annulus between the washer and clamping flange upon installation to the spindle rail.

10 Claims, 5 Drawing Figures

TEXTILE SPINDLE MOUNTING

BACKGROUND OF THE INVENTION

The present invention relates generally to mounting assemblies for textile spindles and relates more particularly to a spindle mounting of a novel noise and vibration attenuating construction.

Vibration of revolving textile spindles has been a long existent problem in textile plants. Such vibrations limit the permissible speeds of operation of revolving spindles, otherwise adversely affect the performance of the spinning operation and create undesirable noise levels within the plant.

A large number of arrangements have been proposed for reducing the vibrations of textile spindles. Many of the proposals suffer from undue complexity which for economic reasons would preclude their acceptance. Furthermore, most proposals cannot be retrofitted to existing spindles without costly alterations. For these and other reasons, despite considerable development efforts, an effective and economical solution to the problem has not been developed prior to the present invention.

SUMMARY OF THE INVENTION

In the present invention, a simple and relatively inexpensive vibration attenuating mounting has been developed which can be used with conventional textile spinning machinery with minimal alterations. The mounting comprises a rigid inner member including an elongate sleeve for attachment around a nonrotating mounting portion of the spindle assembly and a support ring carried by an extending radially from the sleeve. An elastomeric annulus is provided with portions secured to opposite radial faces of the support ring, preferably in radially spaced relation to the sleeve. A rigid washer is secured along a first free radial face of the annulus in radially spaced relation to the sleeve. A cylindrical casing portion of a holder concentrically surrounds the annulus and support ring in radially spaced relation to the support ring. The holder includes a radially inwardly extending clamping flange secured to the other free radial face of the annulus in radially spaced relation to the sleeve. At least a portion of the washer extends axially beyond the cylindrical casing portion. The holder includes radially outwardly directed mounting flanges carried by the casing portion for attachment to the spindle rail of a textile machine. It is preferred that a significant portion of the elastomeric annulus be radially spaced from both the inner sleeve and casing portion of the holder to facilitate shearing of the elastomeric annulus between the support ring and washer and support ring and clamping flange. The elastomeric annulus is preferably bonded to the support ring, washer, and clamping flange to provide a unitary assembly for installation to the spindle assembly and spindle rail.

As shown in the preferred embodiment of the present invention, the sleeve preferably extends axially beyond the washer and clamping flange. The sleeve may be received through the conventional spindle receiving opening of the spindle rail and secured to the spindle assembly such that it is isolated from the spindle rail by the mounting of the present invention without undue restriction of the motions permitted by the mounting. The mounting is attached to the spindle rail by placing the washer in abutting relation to the spindle rail and bolts or screws are disposed through enlarged openings in the mounting flanges and received in threaded bores located in the spindle rail. Upon tightening of the bolts, the elastomeric annulus will be precompressed. The enlarged bolt openings in the mounting flanges allow for centering of the textile spindle and mounting relative to other operating structure of the textile machine.

It is accordingly a first object of the present invention to provide an improved textile spindle mounting which minimizes the transmission of noise and vibration.

A further object of the invention is to provide a spindle mounting as described which can be easily retrofitted to existing spindles.

An additional object is to provide a spindle mounting of a relatively simple construction which can be economically manufactured and installed.

DESCRIPTION OF THE PREFERRED EMBODIMENT

Figure 1:
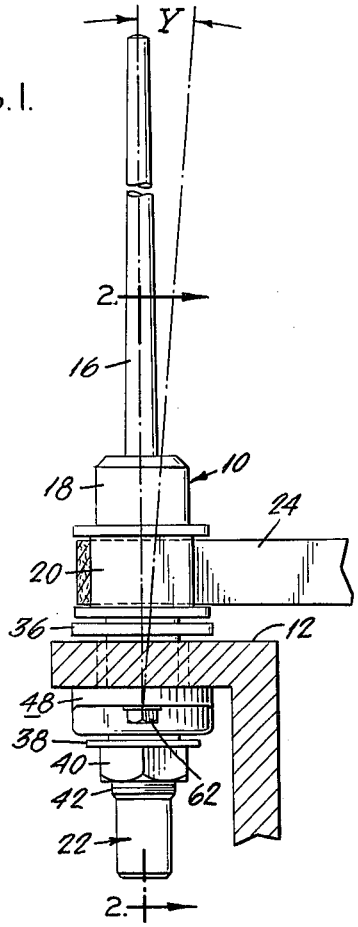
FIG. 1 is a side elevational view partly in section of a textile spindle mounted on a spindle rail of a textile machine by means of a mounting in accordance with the present invention.
Figure 2:
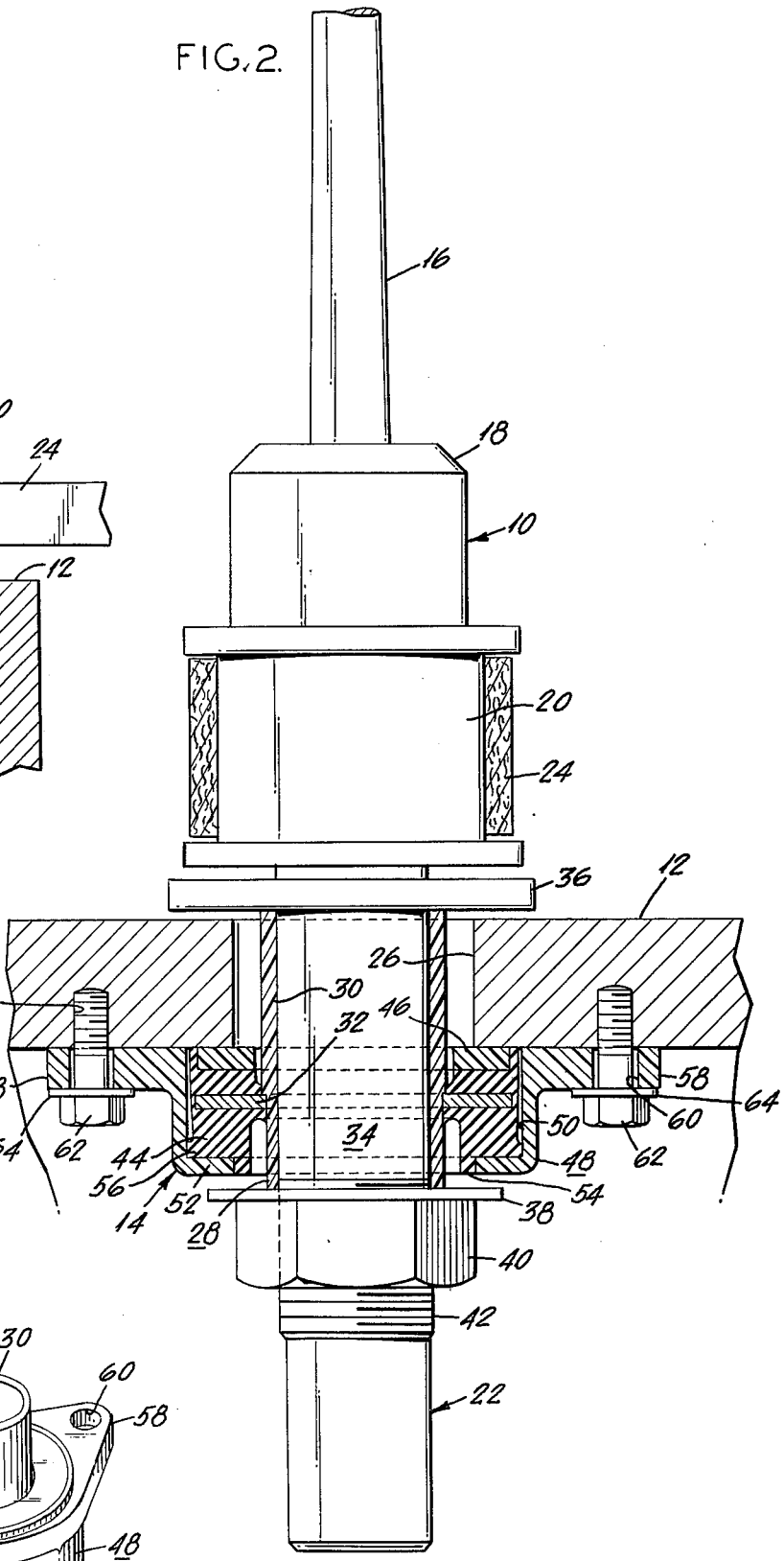
FIG. 2 is an enlarged sectional view taken along line 2—2 of FIG. 1 and showing details of the spindle mounting.

Referring to the drawings, a textile spindle assembly 10 is shown secured to the spindle rail 12 of a textile machine by a mounting 14 in accordance with the present invention. The spindle assembly 10 is of a conventional construction, including a spindle 16, bearing housing 18, whorl 20 and spindle step 22. A drive belt 24 passing around the whorl 20 drives the spindle 16 and the yarn package carried thereon (not shown) in rotation relative to the spindle step 22.

The spindle assembly 10 is supported perpendicularly to the spindle rail 12 by the mounting 14 with the spindle step 22 extending through an enlarged opening 26 in the rail 12. The opening 26 is conventionally larger than required for passage of the spindle step 22 to permit the accurate alignment of the spindle assembly 10 with cooperative elements of the machine.

The mounting 14 comprises a rigid inner member 28 which includes an elongate sleeve 30 and a support ring 32 carried by an extending radially outwardly from the sleeve 30. The sleeve 30 is adapted to fit concentrically around the cylindrical portion 34 of the spindle step 22 and be received through the rail opening 26 while reserving a radial space between the sleeve 30 and spindle rail 12 to permit alignment of the spindle assembly 10. One end of the sleeve 30 abuts a mounting collar 36 carried by the spindle step 22 of the spindle assembly 10 and is clamped axially against the collar 36 by a washer 38 and nut 40 on threaded portion 42 of the spindle step 22. In the illustrated embodiment, the support ring 32 is secured to the sleeve 30 by press fitting the ring 32 onto a reduced diameter portion of the sleeve 30 lower end intermediate of the spindle rail 12 and washer 38. If desired, the sleeve 30 and support ring 32 could be formed as a unitary member either by molding, casting, machining, or the like forming operation.

An elastomeric annulus 44 includes portions secured, preferably bonded, to opposite radial faces of the support ring 32. It is highly desirable that most of the annulus 44 be radially spaced from the sleeve 30. However, some engagement with the sleeve 30 is employed in the present embodiment adjacent the support ring 32 to help secure and maintain it in place on the sleeve 30. The elastomeric annulus 44 also preferably encases the outer edge of the support ring 32. A rigid washer 46, which is preferably made of a material such as nylon or Teflon to reduce noise transmission, is secured, preferably bonded, to the upper free radial face of the annulus 44. The washer 46 is radially spaced from the sleeve 30 and adapted to abuttingly engage the rail 12. The annulus 44 also encases the outer peripheral edge of the washer 46.

A holder 48 is provided which includes a hollow cylindrical casing portion 50 that is concentric with and extends the axial length of the annulus 44 to surround same. The holder 48 also includes an annular clamping flange 52 extending radially inwardly from the lower edge or end of the casing portion 50 that is secured, preferably bonded, to the lower radial free face of the annulus 44. An annular lip portion 54 of the annulus 44 encases the inner edge of the clamping flange 52. The casing portion 50 is radially spaced from the support ring 32, washer 46 and the annulus 44 except for a shoulder portion 56 at the lower end thereof. The clamping flange 52 is also radially spaced from the sleeve 30. A pair of mounting flanges 58 extend in diametrically opposed relation radially outward from the upper end of the holder casing portion 50. An enlarged or oversized opening 60 is provided in each of the mounting flanges 58 and disposed therethrough is a mounting bolt or screw 62, provided with washer 64, which is received within a threaded bore 66 of the rail 12.

Figure 3:
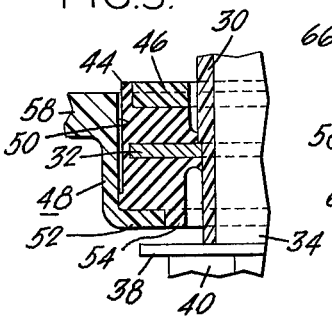
FIG. 3 is a partial sectional view of a portion of the spindle mounting showing the elastomeric annulus in the uncompressed condition.
Figure 4:
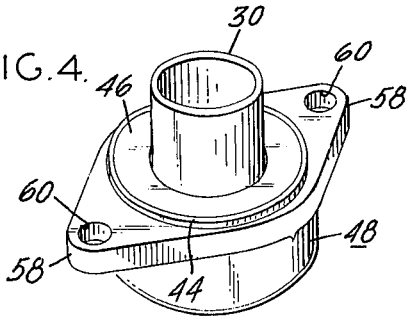
FIG. 4 is a perspective view of the present mounting prior to installation.

Since the fatigue life of most elastomers is relatively short under tension or stretch conditions, it is desirable that all portions of the elastomeric annulus 44 be maintained in compression under all operating conditions of the spindle assembly. To this end, the annulus 44 and washer 46 as shown in FIG. 3 are selected with a predetermined combined axial length slightly greater than the depth of the holder 48 so that at least a portion of the washer 46 extends axially above the upper surface of the holder 48 in the relaxed condition of the annulus 44. Upon installation of the mounting 14 to the spindle rail 12, the elastomeric annulus 44 will be precompressed between the washer 46 and clamping flange 52. The friction between the washer 46 and the spindle rail 12 will prevent slippage therebetween during operation of the spindle assembly. It will be apparent that the degree of precompression obtained upon installation of the mounting 14 will depend upon the degree to which the washer 46 extends axially beyond the casing portion of the holder 48 in its unmounted condition.

The collar 36 should be adequately spaced above the top of the spindle rail 12 so as to preclude contact therewith. Similarly, the washer 38 should be spaced sufficiently below the holder 48 by the extension of the sleeve 30 to prevent contact therebetween.

As indicated above, the mounting 14 is preferably an integral unit with the inner member 28, washer 46 and holder 48 being bonded to the elastomeric annulus 44. The mounting 14, having the appearance shown in FIG. 3, may be readily installed by sliding the spindle step 22 of the spindle assembly 10 into the sleeve 30 of the mounting 14 and applying and tightening the nut 40 to secure the sleeve 30 against the collar 36. The bolts or screws 62 are disposed through the mounting flanges 58 and threaded into the rail bores 66. When the spindle assembly 10 is properly aligned with the cooperating elements of the machine, the bolts or screws 62 are tightened to bring the holder 48 into engagement with the rail 12 and compress the elastomeric annulus 44 to the predetermined degree. The oversize opening 60 in the holder mounting flanges 52 as well as the oversize opening 26 in the rail 12 permit any adjustments required for alignment of the spindle assembly.

In view of the foregoing description, it will be apparent that the mounting 14 will resiliently mount the spindle assembly 10 to a spindle rail 12. Axial loads, upward or downward, are resiliently absorbed by the elastomeric annulus 44 within its limits of compression and stretch. Radial loads are resiliently absorbed by shearing of the elastomeric annulus 44. Combinations of axial and radial loads, cocking, are also resiliently absorbed by the elastomeric annulus 44. The resiliency of the mounting in these various modes can be adjusted to comply with the desired operating characteristics of the mounting by modifications in design of the elastomeric annulus and its precompression. Contact between various rigid parts of the mounting 14 is precluded by the portions of the elastomeric annulus 44 that encases edges of the support ring 32, washer 46 and clamping flange 52. While the mounting 14 has been illustrated and described as being installed to the underside of the rail 12, it could be readily applied to the upperside of the rail 12 with apparent modifications.

Figure 5:
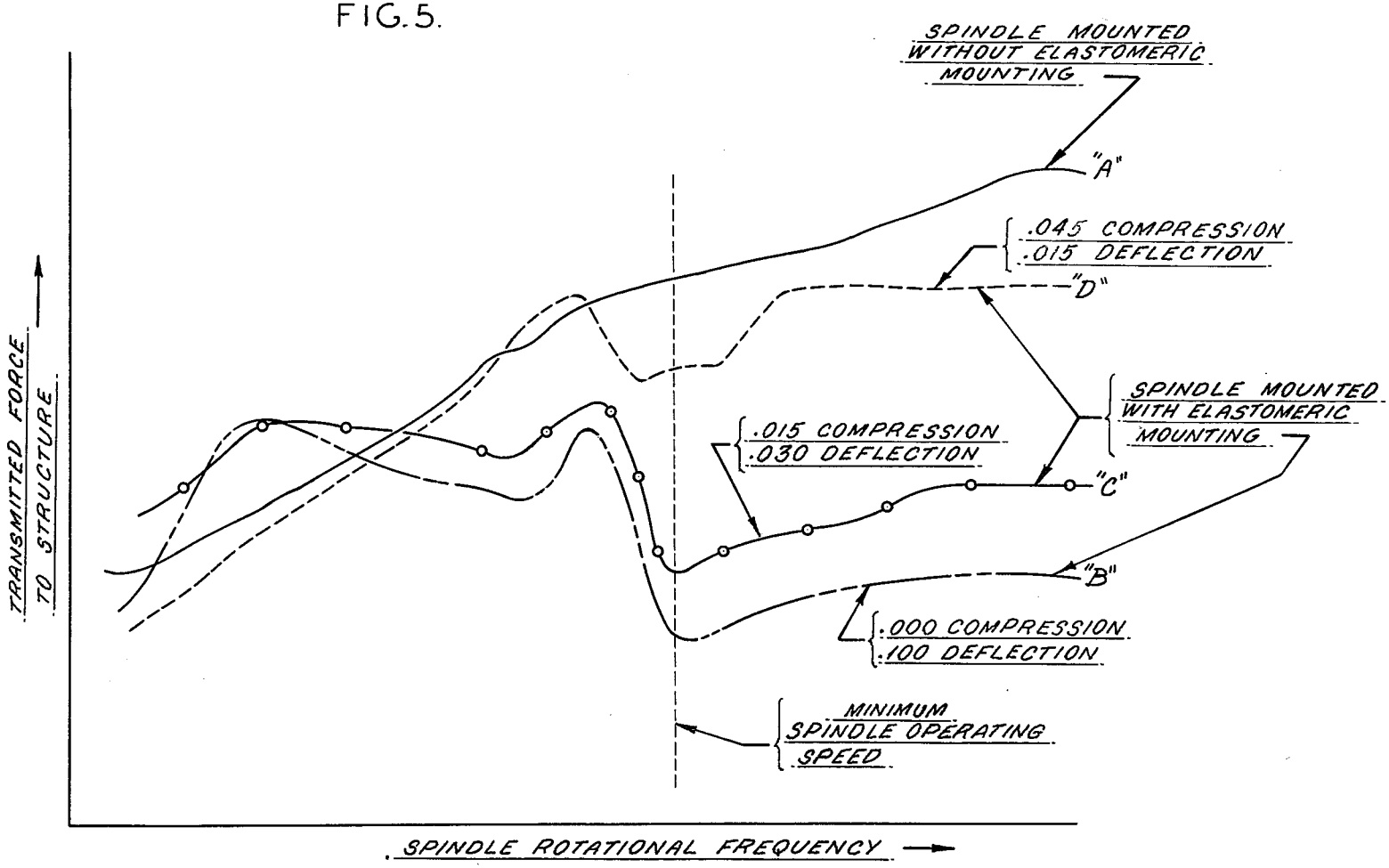
FIG. 5 is a graphical representation of the vibration attenuating effectiveness of the present mounting with various degrees of precompression of the elastomeric annulus.

With reference to FIG. 1, during operation the drive belt 24 exerts a cocking force on the spindle assembly 10 which as illustrated tends to displace the spindle 16 from its normal vertical alignment by an angle Y, the degree of which has been exaggerated in the drawings for purposes of illustration. Among other things, the cocking stiffness of the mounting 14 is dependent upon the degree of precompression of the annulus 44 as illustrated in graphical form in FIG. 5. Curve A of FIG. 5 illustrates for a typical spindle assembly the forces transmitted between the spindle assembly and rail over a range of operating speeds without the mounting of the present invention. Curve B shows the transmitted force utilizing the present mounting but without any precompression of the annulus 44. It will be noted that the transmitted force is relatively low, but that the deflection of the spindle due to the cocking force of the drive belt, 0.100 inch measured at the upper end of the spindle is relatively high. In curve C, a precompression of 0.015 inch results in a transmitted force somewhat higher than that of curve B but materially stiffens the spindle mounting against cocking, resulting in a deflection approximately one-third of that in the uncompressed condition. In curve D, a substantially higher precompression of the annulus, 0.045 inch, results in considerably more transmitted force but produces a cocking stiffness allowing only a 0.015 inch deflection of the spindle with the same drive belt force as in curves B and C.

Although a variety of materials could be utilized for the inner member, washer and holder, a rigid plastic material such as nylon is particularly wellsuited for such purposes, especially for the washer and holder to further minimize noise transmission to the rail. The elastomeric annulus may be formed of a natural or synthetic rubber and may be molded in place or bonded to the mounting elements by an adhesive to provide a unitary assembly.

Manifestly, changes in details of construction can be effected by those skilled in the art without departing from the spirit and scope of the invention.

What is claimed is:

1. A noise and vibration attenuating mounting for a textile spindle assembly comprising a rigid inner member including an elongate sleeve adapted for concentric attachment to the spindle assembly and a support ring carried by and extending radially from said sleeve, annular elastomeric means having portions secured to opposite radial faces of said support ring, a rigid washer secured along a first free radial face of said elastomeric means in parallel relation to said support ring and in radially spaced relation to said sleeve, a holder having a cylindrical casing portion concentrically surrounding said elastomeric means and support ring in radially spaced relation to said support ring and including radially outwardly directed mounting flanges, said holder including a radially inwardly directed annular clamping flange spaced from said sleeve and secured to a second free radial face of said elastomeric means opposite said first radial face, said washer at least partially extending axially beyond said mounting flanges of the holder, at least one annular axial surface of said elastomeric means being spaced radially from an adjacent axial surface of one of said elongate sleeve and said casing portion of the holder so as to permit radial shearing of the elastomeric means, the axial extent of the washer beyond the mounting flanges and the radial spacing of said elastomeric means being such that upon attachment of said mounting to a textile machine said elastomeric means is precompressed between the washer and the clamping flange and said axial surface of the elastomeric means remains spaced from said adjacent axial surface.

2. The mounting, as claimed in claim 1, wherein at each point along its length said elastomeric means is spaced radially about a circumference from at least one of said elongate sleeve and said casing portion of said holder and wherein a portion of said elastomeric means is radially spaced from both said elongate sleeve and said casing portion of said holder.

3. The mounting, as claimed in claim 1, wherein said mounting flanges comprise a pair of diametrically opposed flanges.

4. The mounting, as claimed in claim 1, wherein said elastomeric means is bonded to said inner member, washer and holder.

5. The mounting, as claimed in claim 1, wherein said elongate sleeve extends axially beyond said washer and mounting flange.

6. In combination, a textile spindle assembly, a textile machine spindle rail having an opening adapted to receive therethrough a downwardly extending portion of said spindle assembly and a noise and vibration attenuating mounting securing said spindle assembly to said rail, said mounting comprising a rigid inner member including an elongate sleeve concentrically secured about said downwardly extending portion of said spindle assembly and received through said rail opening in radially spaced relation to said rail and a support ring carried by and extending radially from said sleeve in axially spaced relation to said rail, annular elastomeric means having portions secured to opposite radial faces of said support ring, a rigid washer secured along a first free radial face of said elastomeric means adjacent said rail in parallel relation to said support ring and in radially spaced relation to said sleeve, a holder having a cylindrical casing portion concentrically surrounding said elastomeric means and support ring in radially spaced relation to said support ring and including radially outwardly directed mounting flanges, said holder including a radially inwardly directed annular clamping flange spaced from said sleeve and secured to a second free radial face of said elastomeric means opposite said first radial face, and means for securing said mounting flanges to said rail, the washer at least partially extending axially beyond the mounting flanges of the holder in the uncompressed condition of the elastomeric means, at least one annular axial surface of said elastomeric means being spaced radially from an adjacent axial surface of one of said elongate sleeve and said casing portion of the holder so as to permit radial shearing of the elastomeric means, the axial extent of the washer beyond the mounting flanges and the radial spacing of said axial surfaces being such that when the mounting flanges of the holder are secured to the rail said elastomeric means is precompressed between the washer and the clamping flange and said axial surface of the elastomeric means remains spaced from said adjacent axial surface.

7. The invention, as claimed in claim 6, wherein said spindle assembly includes a mounting collar spaced from said rail on the side thereof opposite said mounting with opposite ends of said sleeve clamped between said collar and abuttment means carried by said spindle assembly.

8. The invention, as claimed in claim 6, wherein said means for securing said mounting flanges to the rail comprises an opening in each mounting flange, a threaded bore in said rail corresponding to each said flange opening, a bolt disposed through each said flange opening and threadably received in the corresponding rail bore, said flange openings being oversized relative to said bolts to permit adjustment of the spindle alignment during installation.

9. The invention, as claimed in claim 8, wherein said mounting flanges comprise a pair of diametrically opposed flanges.

10. The invention, as claimed in claim 6, wherein at each point along its length said elastomeric means is spaced radially about a circumference from at least one of the elongate sleeve and the casing portion of the holder, and wherein a portion of said elastomeric means is spaced radially from both the elongate sleeve and the casing portion of the holder.

* * * * *